US007010143B2

(12) United States Patent
Kam

(10) Patent No.: US 7,010,143 B2
(45) Date of Patent: Mar. 7, 2006

(54) RECTANGULAR PANEL-FORM LOUDSPEAKER AND ITS RADIATING PANEL

(76) Inventor: Tai-Yan Kam, 4F. No. 3 2nd Allay 86th Lane, Chien Kung 1st Rd., Hsin Chu 300 (TW)

( * ) Notice: Subject to any disclaimer, the term of this patent is extended or adjusted under 35 U.S.C. 154(b) by 357 days.

(21) Appl. No.: 10/225,692

(22) Filed: Aug. 22, 2002

(65) Prior Publication Data

US 2004/0037447 A1 Feb. 26, 2004

(51) Int. Cl.
*H04R 25/00* (2006.01)

(52) U.S. Cl. ..... 381/426; 381/423; 381/431; 381/428; 381/152

(58) Field of Classification Search ..... 381/152, 381/423, 431, 190, 396, 426, 428, 425; 181/167, 181/169, 170, 157, 166
See application file for complete search history.

(56) References Cited

U.S. PATENT DOCUMENTS 4,426,556 A 1/1984 Saiki et al.
6,332,029 B1 * 12/2001 Azima et al. ..... 381/152
6,453,049 B1 9/2002 Chu et al.
6,478,109 B1 11/2002 Kam

FOREIGN PATENT DOCUMENTS

JP 56-132098 10/1981
JP 57-2193 1/1982

* cited by examiner

*Primary Examiner*—Huyen Le
*Assistant Examiner*—Tuan Duc Nguyen
(74) *Attorney, Agent, or Firm*—Michael Best & Friedrich LLP

(57) ABSTRACT

A structure of a rectangular panel-form loudspeaker is provided. The structure includes a radiating panel, a transducer, a frame and a suspending unit. The radiating panel includes a rectangular laminated composite plate with length b and width a, and the laminated composite plate includes an intermediate core layer sandwiched between two fiber-reinforced polymeric layers. The transducer is used for exciting the radiating panel to produce flexural vibration. The transducer includes a voice coil assembly and a magnet assembly, wherein the voice coil assembly is coupled to a first side of the laminated composite plate at a first specified location. The frame is used for positioning the laminated composite plate and the magnet assembly. The suspending unit is made of a soft material and disposed between peripheral edges of the laminated composite plate and the frame.

23 Claims, 10 Drawing Sheets

A-A Cross section

B-B Cross section

RECTANGULAR PANEL-FORM LOUDSPEAKER AND ITS RADIATING PANEL

FIELD OF THE INVENTION

The present invention relates to a rectangular panel-form loudspeaker, and more particularly to a rectangular panel-form loudspeaker for producing a uniform sound pressure sensitivity spectrum. The present invention also relates to a radiating panel of the rectangular panel-form loudspeaker.

BACKGROUND OF THE INVENTION

A conventional loudspeaker utilizes a round-shaped electromagnetic transducer to drive a cone-type membrane to radiate sound. In general, an additional enclosure is necessary to facilitate sound radiation, which makes the loudspeaker cumbersome, weighty and having dead corner for sound radiation, etc. Recently, flat display and mobile communication devices such as notebook, cellular phone and personal digital assistant (PDA), are rapidly developed toward miniaturization. The integration of transparent panel-form loudspeakers with the flat display and mobile communication devices can greatly enhance the performance of such devices. Therefore, such conventional loudspeaker is gradually replaced by a panel-form loudspeaker.

FIGS. 1(*a*) and 1(*b*) are respectively top view and cross-sectional view of a traditional panel-form loudspeaker. Such panel-form loudspeaker comprises an electromagnetic transducer 10, a radiating panel 20, a frame 30, and a suspending unit 50. The transducer 10 has a resilience support 12 therein. The frame 30 is employed for supporting the transducer 10 and the radiating panel 20. The suspending unit 50 is composed of soft material to suspend the radiating panel 20 onto the frame 30.

The typical transducer for exciting a radiating panel to generate flexural vibration includes two types. FIGS. 2(*a*) and 2(*b*) illustrate cross-sectional views of two typical transducers. Each transducer comprises a cylindrical voice coil assembly 170 and a magnet assembly having at least a permanent magnet 182, at least a top plate 181 and a permeance unit 183. The voice coil assembly 170 has a moving coil 172 supported by the resilience support 12 and immersed in a magnetic field at a gap between the top plate 181, the permanent magnet 182 and the permeance unit 183. When electric current flow through the moving coil 172, the cylindrical voice coil assembly 170 will be forced to move back and forth vertically, thereby driving the radiating panel to radiate sound. In general, the resilience support 12 also works as a damper to suppress undesirable vibrations of the radiating panel 20. The transducer 10 is usually arranged at the center of the radiating panel 20 and the rigidity of the radiating panel is increased by the resilience support 12, which leads to a relatively higher initial response frequency, and considerable fluctuations of the sound pressure spectrum over the audible frequency range by exciting the radiating panel 20. In addition, when input power is augmented, a more apparent non-linear relation exists between the pressure response and the power. In order to obtain a more uniform distribution of sound pressure spectrum over the audible frequency range, U.S. Pat. No. 4,426,556 disclosed a method to excite a rectangular radiating panel by using two transducers. In such way, a more uniform distribution of sound pressure spectrum is provided. However, since locations of these two transducers are close to the short edge of the radiating panel, the radiating efficiency is reduced due to a diminished vibration.

On the other hand, the radiating panel for the traditional panel-form loudspeaker was made of metal, paper, polymer or non-woven cloth. Such materials are not suitable for producing radiating panels because they have weighty, low stiff and insufficient damping properties.

THEORETICAL BACKGROUND OF THE PROPOSED METHOD

An effective modal parameters identification method is widely used to design panel-form loudspeakers. This effective modal parameters identification method is provided based on a modal vibration method, a Rayleigh's first sound pressure integral method and a sound pressure optimization method. In accordance with the effective modal parameters identification method, the modal parameters includes thickness and laminating angle of the radiating panel, locations of excitation on the radiating panel and locations and modulus of the suspending unit.

For a radiating panel baffled on the peripheral edges under flexural vibration, the sound pressure radiated from the radiating panel can be evaluated using a Rayleigh's first integral formula. The expression in integral form is $$p(r,t) = \frac{i\omega\rho_o}{2\pi} e^{i\omega t} \int_s \frac{V_n(r_s,t)e^{-ikR}}{R} ds \tag{1}$$

where p(r, t) is sound pressure at a distance r from the origin on the surface of the radiating panel, R is the distance between the observation point and the position of a differential surface element on the vibrating plate, $r_s$ is a distance away from the origin, $\rho_o$ is air density, t is time, S is area of the vibrating plate, ω is a vibrating frequency of the radiating panel, $V_n(r_s,t)$ is a normal velocity of the radiating panel, and $i=\sqrt{-1}$.

A sound pressure sensitivity at the point of observation is obtained from the equation $$L_p = 20 \log_{10} \frac{P_{rms}}{P_{ref}} \tag{2}$$

where $L_p$ is the sound pressure sensitivity, $P_{rms}$ is the root-mean-square value of sound pressure at the point of observation, $P_{ref}$ is the reference pressure which is a constant. Therefore, a sound pressure sensitivity spectrum over the audible frequency range can be evaluated to provide a more uniform distribution of sound pressure sensitivity spectrum, which is necessary for designing a panel-form loudspeaker with high fidelity.

In view of Equation (1), for a specific point of observation, the sound pressure and the vibrating frequency ω depend on the normal velocity $V_n$. A suitable velocity distribution over a broad vibrating frequency of the radiating panel is required for obtaining a more uniform distribution of sound pressure sensitivity spectrum over a specified frequency range. It is assumed that the origin of the X-Y coordinates is located at the center of the radiating panel and the X-axis and the Y-axis are parallel with the long edge and show edge of the radiating panel, respectively. In view of the integral component of the Equation (1), the computed sound pressure depends on the symbols of the normal velocity $V_n$. When the normal velocity of the radiating panel is unsymmetrical in respect to the X-Y coordinates, i.e. the radiating panel has an unsymmetrical modal shape, the sound pressures produced from the radiating panel will be diffracted or interfered with each other. Therefore, the measured sound pressure is reduced to a great extent. Since the velocity distribution of the radiating panel is directed to the vibration mode thereof, it is required to realize and modulate the unfavorable vibration modes so as to facilitate exciting the radiating panel with a suitable vibration mode. The velocity component of Equation (1) for example can be determined according to a finite element method or modal analysis to realize the velocity distribution of the radiating panel. The deflection of the radiating panel is approximated as the sum of the modal deflections expressed in the following form $$D(r_s, t) = \sum_{i=1}^{n} A_i \Phi_i(r_s) \sin(\omega t - \theta_i) \tag{3}$$

where D is displacement, n is the number of vibration modes under consideration, $\theta_i$, $A_i$ and $\Phi_i$ are phase difference, modal amplitude and modal shape of the ith vibration mode, respectively. When D is differentiated by time in Equation (3), the velocity is obtained form the following equation $$V_n(r_s, t) = \sum_{i=1}^{n} A_i \omega \Phi_i(r_s) \cos(\omega t - \theta_i) \tag{4}$$

In view of Equation (4), the velocity distribution on the radiating panel is dependent on the modal parameters $\theta_i$, $A_i$ and $\Phi_i$. On the other hand, in accordance with vibration mode principles, the modal amplitude depends on the excitation force as well as a ratio of the natural frequency under such vibration mode to the exciting frequency, flexural rigidity of the radiating panel, damping value and supporting point, etc. Once the frequency of the excitation force coincides with the natural frequency, a resonant mode takes place. At that time, the modal amplitude reaches its maximum. If the location of excitation is just at the greatest displacement, the modal amplitude will be augmented and the sound pressure sensitivity at this frequency will be increased abruptly. In addition, if the location of excitation is at modal node lines of a resonant mode, the resonance modal shape will not be induced. Therefore, the velocity of the radiating panel is diminished and an unsatisfactory sound pressure is obtained. In view of Equation (4), when other modal amplitude has effects on a velocity at this frequency, a sound pressure is obtained at this frequency. Thus, a suitable vibration mode has an important effect on sound radiation of the radiating panel. The magnitude of damping also has an important effect on the modal amplitude. A suitable damping is advantageous for sound radiation. Preferably, the damping ratio for the radiating panel is less than 10%. The flexural rigidity of the radiating panel is dependent on a ratio of modulus to density, a ratio of length to thickness and the supporting point. It is known that the flexural rigidity is in an inverse proportion to the modal amplitude. However, the natural frequency of the radiating panel is in proportion to the flexural rigidity. That is to say, the frequency is increased with the flexural rigidity. Although the natural frequency of the resonant mode does not appear in Equation (4), as above mentioned, the modal amplitude will be affected due to a change of the ratio of natural frequency to exciting frequency. Therefore, it is found that the natural frequency has an important relation with the velocity. In general, the natural frequency distribution of a radiating panel lies in the frequency ranges of various sound levels. As a result, when the radiating panel is excited at different frequencies, a displacement response facilitating sound radiation at the natural frequencies neighboring these frequencies. The abruptly increased sound pressure sensitivity will no longer take place even if the location of excitation is at modal node lines of a vibration mode. The edge strip on the radiating panel can be simulated as a damper, whose damping value, softness and location have effects on the vibration mode of the radiating panel. In particular, the modal shape of the radiating panel will be varied with selection of different strip locations. As mentioned above, some modal shape such as unsymmetrical modal shape may retard generation of a uniform sound pressure sensitivity distribution. When a suitable supporting point and specified locations are selected, this undesirable modal shape can be avoided. In Equation (4), the phase difference and parameters such as damping and natural frequency are dependent on the exciting frequency; therefore, when the radiating panel and the suspending unit are decided, the phase different of the radiating panel can be adjusted by changing rigidity thereof.

In recent years, optimization methods have been extensively used in the design of engineering products. Since the use of an appropriate optimization method can produce the best design for an engineering product in an efficient and effective way, it is thus advantageous to use an optimization method in the design of the rectangular panel-form loudspeaker of the present invention. Here, a two-level optimization technique is adopted to design a rectangular radiating panel with given area. In the first level optimization, for a given locations of excitation and supporting points, the optimized radiating efficiency, i.e. the maximum energy is included in the sound pressure spectrum, is determined according to the optimized values selected from the ratio of elastic modulus to density in fiber direction, included angles and laminae for a laminated composite plate and the location of the traducer. In the second optimization, a more uniform sound pressure spectrum is optimized. In mathematical form, the second optimization is stated as $$\varepsilon = \sum_{i=1}^{m} (P_i - \overline{P})^2 \tag{5}$$

where $\epsilon$ is error function, $P_i$ is a sound pressure at an exciting frequency $\omega_i$, $\overline{P}$ is the average sound pressure of the m sound pressure, i.e.

$$\overline{P} = \frac{1}{m} \sum_{i=1}^{m} P_i.$$

At that time, the object of this second level optimization is to minimize the error function $\epsilon$ for obtaining a more uniform sound pressure sensitivity spectrum over a specific frequency range according to the softness and supporting points of the edge strips. The above two level optimizations can be accomplished by using for example the genetic algorithm or any stochastic global optimization technique.

Therefore, for a rectangular radiating panel with given area, it is concluded that the modal parameters for a radiating panel are important to effectively radiate sound. Furthermore, it is required to identify the effective modal shape and properly modify the modal parameters, thereby avoiding generation the undesirable modal shape.

SUMMARY OF THE INVENTION

It is an object of the present invention to provide a structure of a rectangular panel-form loudspeaker and a radiating panel, in which uni-axial fiber-reinforced polymeric laminae are employed to manufacture the radiating panel, so as to produce a more uniform sound pressure sensitivity spectrum over a specific frequency range and increase the efficiency of sound radiation.

It is another object of the present invention to provide a structure of a rectangular panel-form loudspeaker and a radiating panel, in which an effective modal parameters identification method to determine the optimal parameters such as thickness, included angles and excitation location for the radiating panel, and supporting points and softness for the edge strips.

It is another object of the present invention to provide a structure of a rectangular panel-form loudspeaker, in which there is no resilience support between the voice coil assembly and the magnet assembly, so as to avoid the influence of the resilience support on the increasing rigidity of the radiating panel.

The above objects are achieved by a structure of a rectangular panel-form loudspeaker according to the present invention. The structure includes a radiating panel, a transducer, a frame and a suspending unit. The radiating panel includes a rectangular laminated composite plate with length b and width a, and the laminated composite plate includes an intermediate core layer sandwiched between two fiber-reinforced polymeric layers. The transducer is used for exciting the radiating panel to produce flexural vibration. The transducer includes a voice coil assembly and a magnet assembly, wherein the voice coil assembly is coupled to a first side of the laminated composite plate at a first specified location. The frame is used for positioning the laminated composite plate and the magnet assembly. The suspending unit is made of a soft material and disposed between peripheral edges of the laminated composite plate and the frame.

The above objects are also achieved by a radiating panel of the present invention. The radiating panel includes an intermediate core layer having a first rigidity and two fiber-reinforced polymeric layers on a first and a second side of the intermediate core layer. Each fiber-reinforced polymeric layer has a second rigidity in the fiber direction and a third rigidity in a matrix direction. The intermediate core layer and the two fiber-reinforced polymeric layers are laminated to define a rectangular laminated composite plate with length b and width a.

The above objects and advantages of the present invention will become more readily apparent to those ordinarily skilled in the art after reviewing the following detailed description and accompanying drawings, in which:

BRIEF DESCRIPTION OF THE DRAWINGS

FIG. 3(*b*) is a cross-sectional view of FIG. 3(*a*) on the line A—A;

FIG. 3(*c*) is a cross-sectional view of FIG. 3(*a*) on the line B—B;

DETAILED DESCRIPTION OF THE PREFERRED EMBODIMENT

It is found that uni-axial fiber-reinforced laminae have advantages of low weight, high rigidity in fiber direction and good damping property. Therefore, uni-axial fiber-reinforced laminae are suitable for manufacturing radiating panels when the lamination thereof is optimized to result in a proper vibration mode for sound radiation and a uniform and sensitive sound pressure distribution.

The major parameters relating to modal parameters for exciting a radiating panel include locations of excitation, a ratio of length to thickness for the radiating panel, a ratio of modulus to density in fiber direction, included angles for a laminated composite plate, and softness and supporting point of strips for a suspending unit. It is required to select suitable parameters to excite effective vibration modes so as to avoid abruptly increased sound pressure sensitivity and produce a uniform distribution of sound pressure spectrum over a specified frequency range. In accordance with the present invention, the effective modal parameters identification method is utilized to analyze vibration modes and sound pressure sensitivity spectrum, thereby identifying advantageous modal parameters for sound radiation.

Figure 1A:
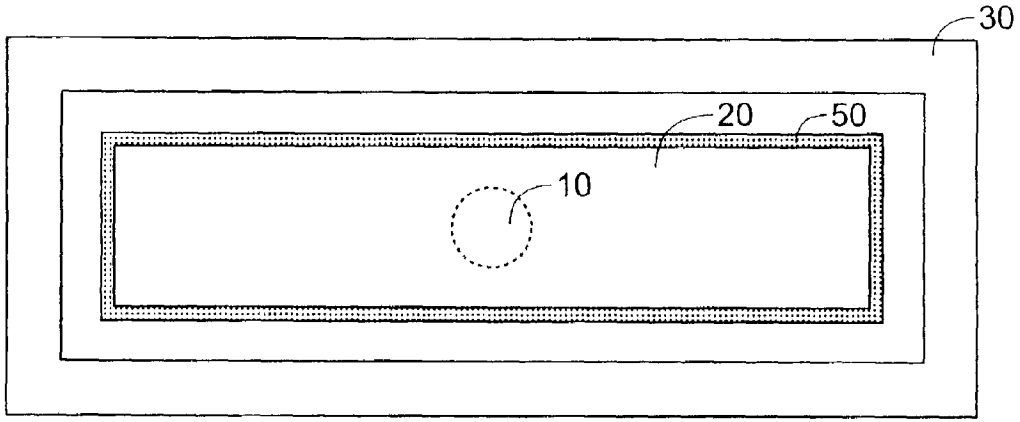
FIGS. 1(*a*) and 1(*b*) are respectively top view and cross-sectional view of a traditional panel-form loudspeaker.
Figure 1B:
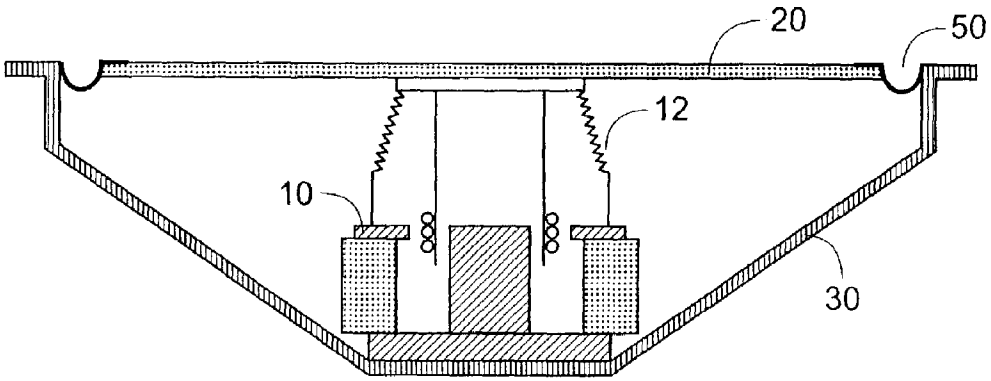
Figure 2B:
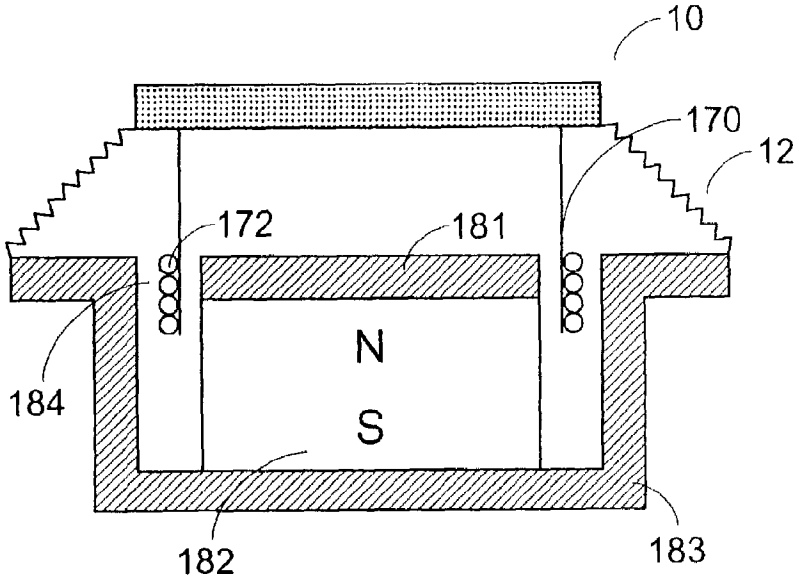
FIGS. 2(*a*) and 2(*b*) illustrate cross-sectional views of two typical transducers.
Figure 2A:
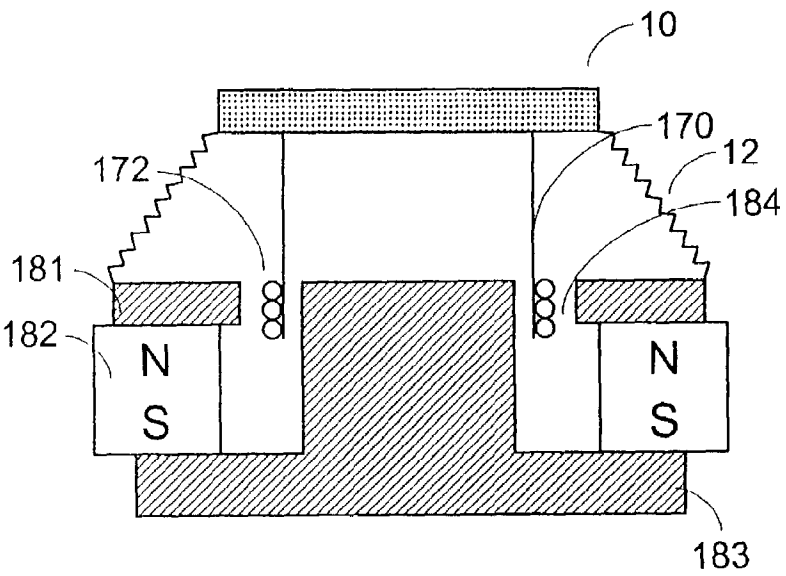
Figure 3A:
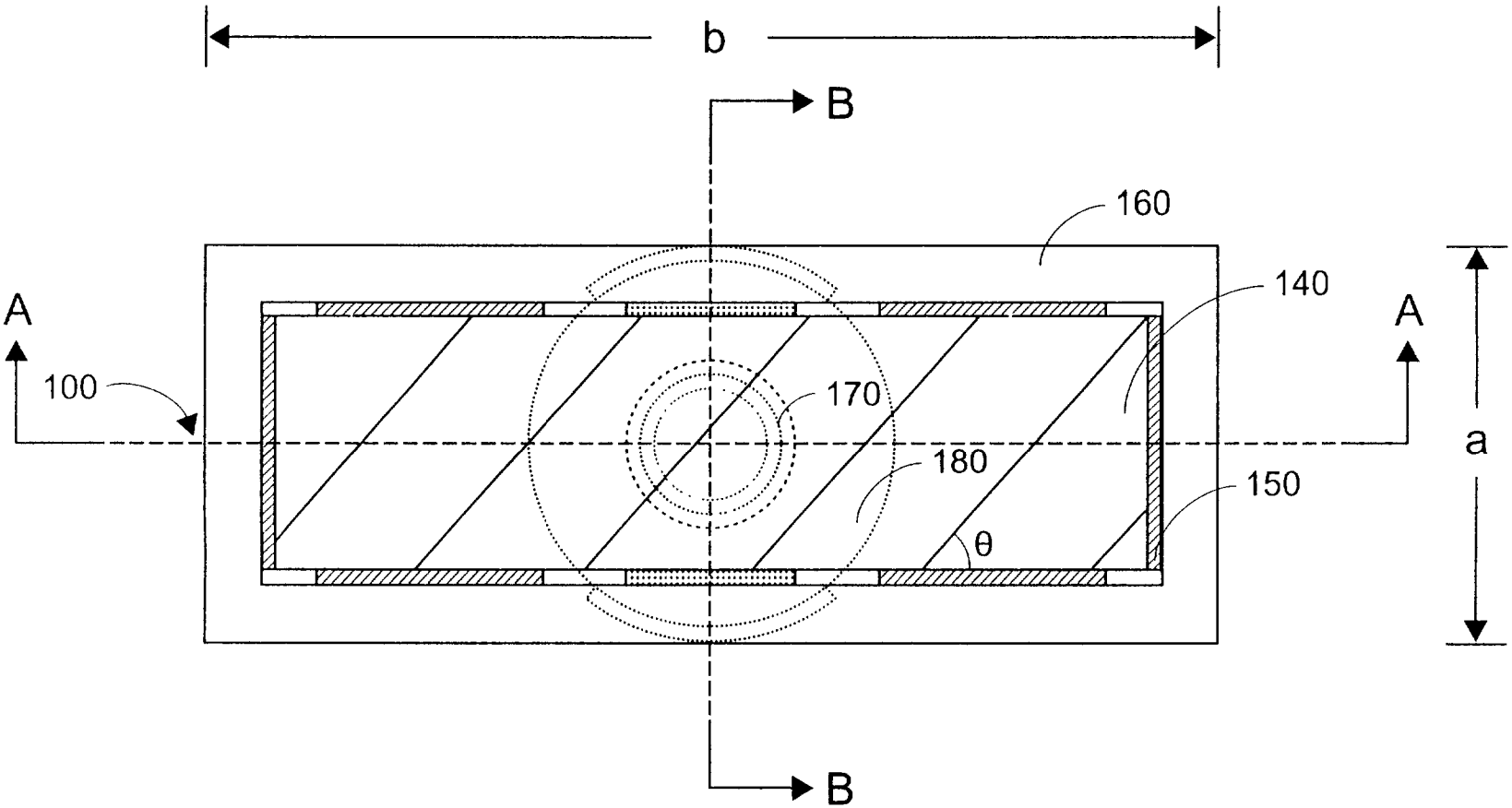
FIG. 3(*a*) is a front view of a rectangular panel-form loudspeaker according to a preferred embodiment of the present invention.
Figure 3B:
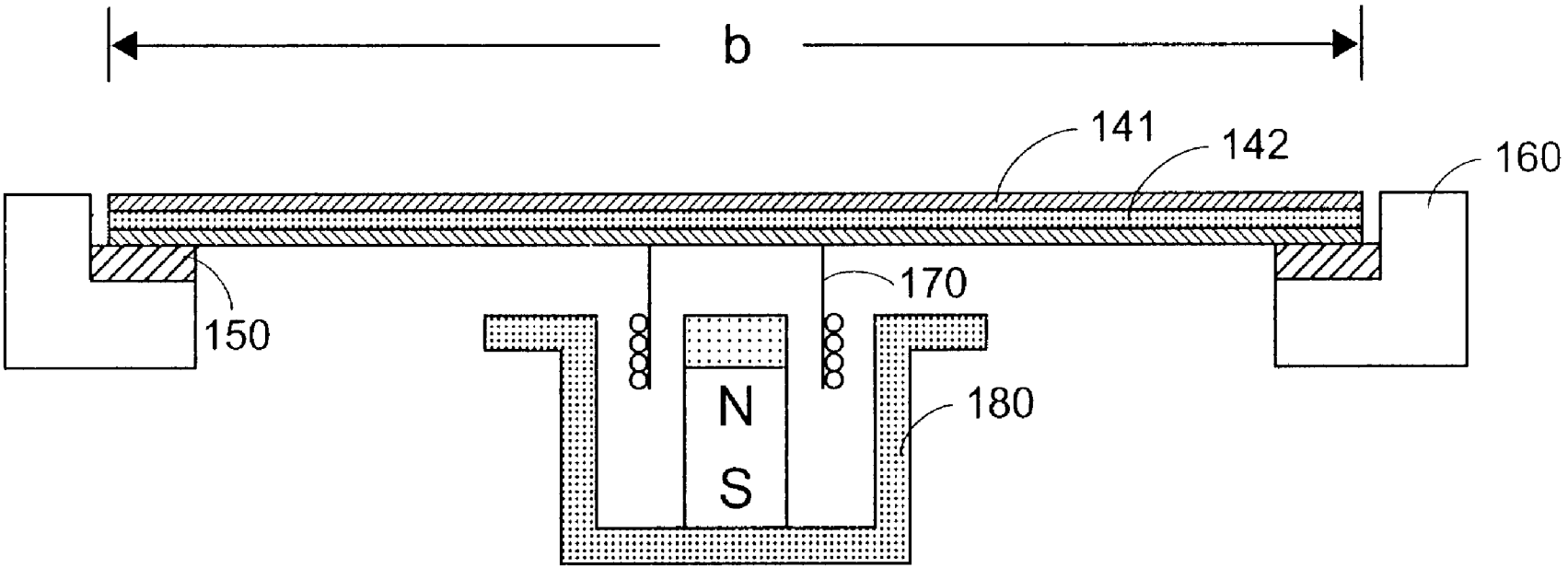
Figure 3C:
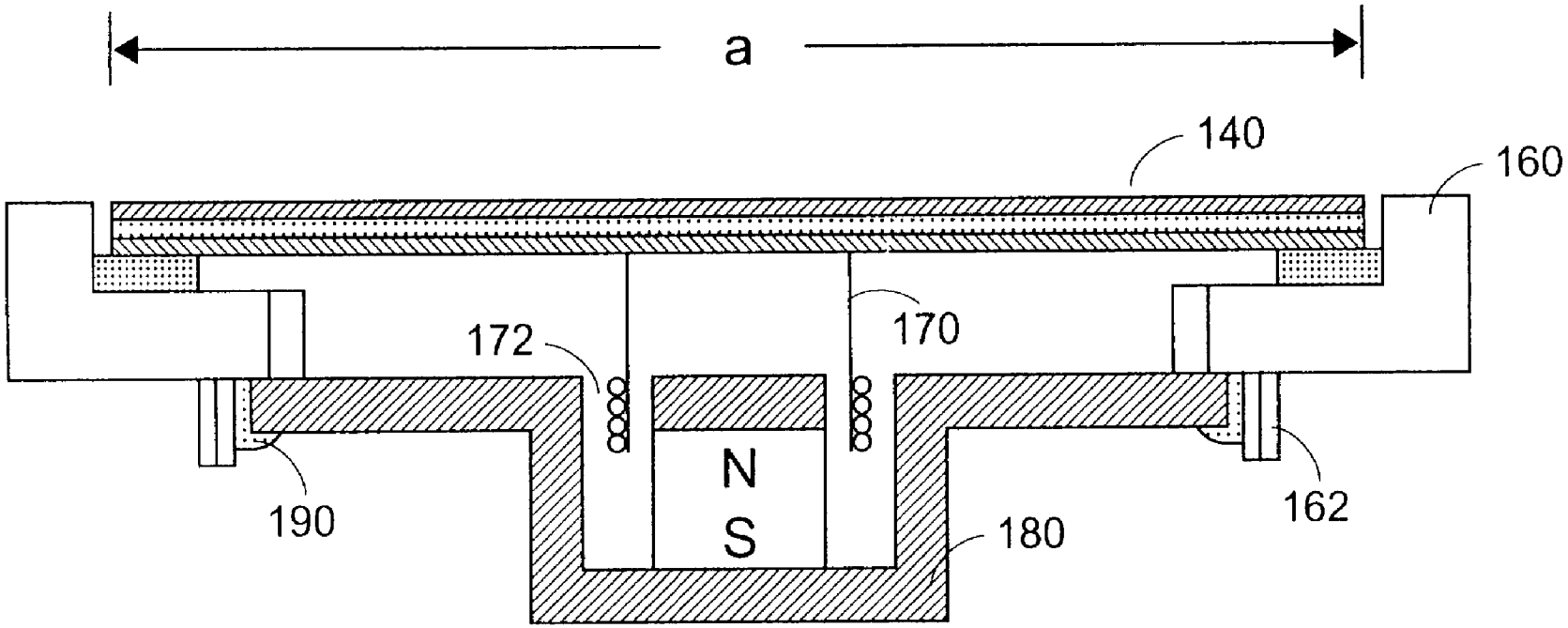

Please refer to FIGS. 3(*a*) to 3(*c*). The rectangular panel-form loudspeaker 100 comprises a laminated composite plate 140, a voice coil assembly 170, a magnet assembly 180, a frame 160 and a suspending unit 150.

The laminated composite plate 140 is used as a radiating panel and has a rectangular shape with length b and width a. Preferably, the ratio of b to a is greater than 1.3. The laminated composite plate 140 comprises an intermediate core layer 142 and two fiber-reinforced polymeric layers 141. The intermediate core layer 142 is sandwiched between these two fiber-reinforced polymeric layers 141. The voice coil assembly 170 is attached to a bottom side of the laminated composite plate 140 at a specified location. The magnet assembly 180 is in a cap-like shape and has a magnetic field generated within a gap at the top region. The magnet assembly 180 is combined with the voice coil assembly 170 to form a transducer for exciting the radiating panel 140 to produce flexural vibration. The frame 160 is substantially rectangular and used for positioning the laminated composite plate 140 and the magnet assembly 180. The suspending unit 150 is made of a soft material and disposed between peripheral edges of the laminated composite plate 140 and frame 160. The detailed structure of each component will be illustrated as follows.

Figure 4:
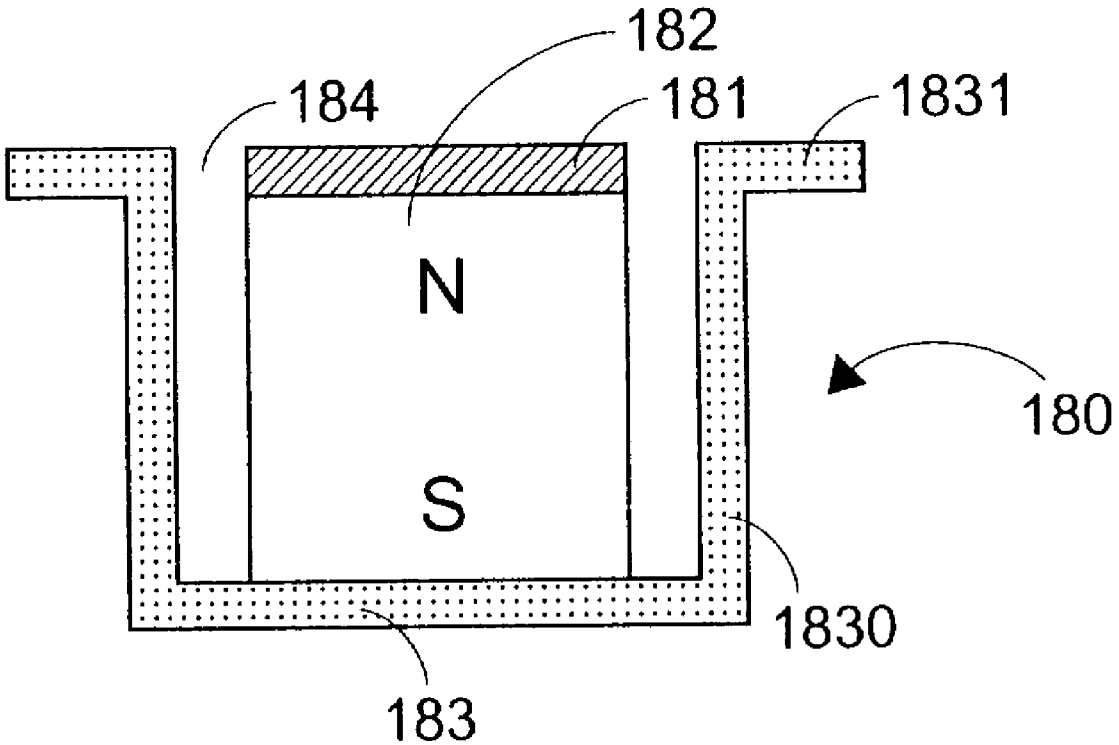
FIG. 4 is a view of a magnet assembly applied to a rectangular panel-form loudspeaker of the present invention.

Referring to FIG. 4, the magnet assembly comprises a disk-shaped top plate 181, a cylindrical permanent magnet 182 and a cap-like permeance unit 183. The permanent magnet 182 and the top plate 181 are disk-shaped and cylindrical, respectively. The top surface of the permanent magnet 182 is attached to the top plate 181 concentrically. The permeance unit 183 comprises a cup 1830 and a ring edge 1831 extending from a mouth of the cup 1830. The top plate 181 and the permanent magnet 182 are disposed within the cup 1830. The bottom surface of the permanent magnet 182 is attached to the bottom surface of the cup 1830. The top plate 181 is at a level substantially similar to that of the ring edge 1831, thereby generating a magnetic field in a gap 184 between the top plate 181, the permanent magnet 182 and the permeance unit 183.

Figure 5:
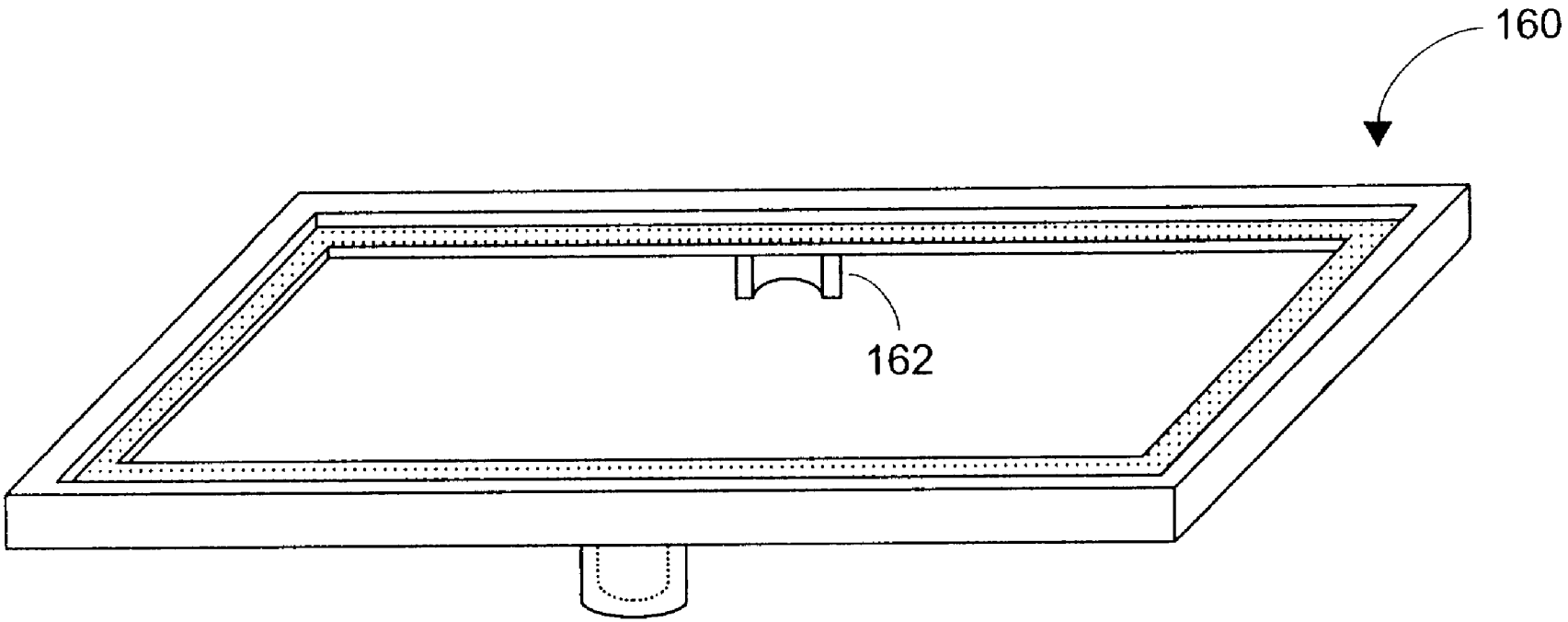
FIG. 5 is a view of a frame applied to a rectangular panel-form loudspeaker of the present invention.

Referring to FIG. 5, the frame 160 is substantially in a rectangular shape with a hollow region in the center. The ratio of long peripheral edge to the short peripheral edge and the area of the frame 160 are essentially similar to b/a and area of the radiating plate 140, respectively. Please refer to FIG. 5 and also FIG. 3. The cross section of the frame 160 is substantially L-shaped. The horizontal and vertical portion of the L-shaped cross section are referred as a bottom side and a peripheral side for supporting the suspending unit 150 and surrounding the laminated composite plate 140, respectively. Furthermore, each of the two long peripheral edges of the frame 160 has a protruding ear 162 corresponding to the ring edge 1831 of the permeance unit 183. When the ring edge 1831 of the permeance unit 183 is engaged with these two protruding ears 162, the magnet assembly 170 and the voice coil assembly are combined and the coil 172 is immersed the gap 184, thereby assembling a transducer. It is found that there is no resilience support between the voice coil assembly 170 and the magnet assembly 180. After the magnet assembly 180 is coupled with the frame 160 by using gluing 190 between the ring edge 1831 and these two protruding ears 162, the rectangular panel-form loudspeaker 100 of the present invention is finished. When electric current flows through the coil 172, the voice coil assembly 170 will produce a motion in a direction vertical to the magnetic field immersed in the gap 184 so as to excite the laminated composite plate 140 to generate flexural vibration. At that time, the required damping property is provided by the structure of the radiating panel 140 and the suspending unit 150. The optimized laminated composite plate is able to excite effective shape of vibration mode and produce a uniform distribution of sound pressure spectrum over a specified frequency range.

Figure 6:
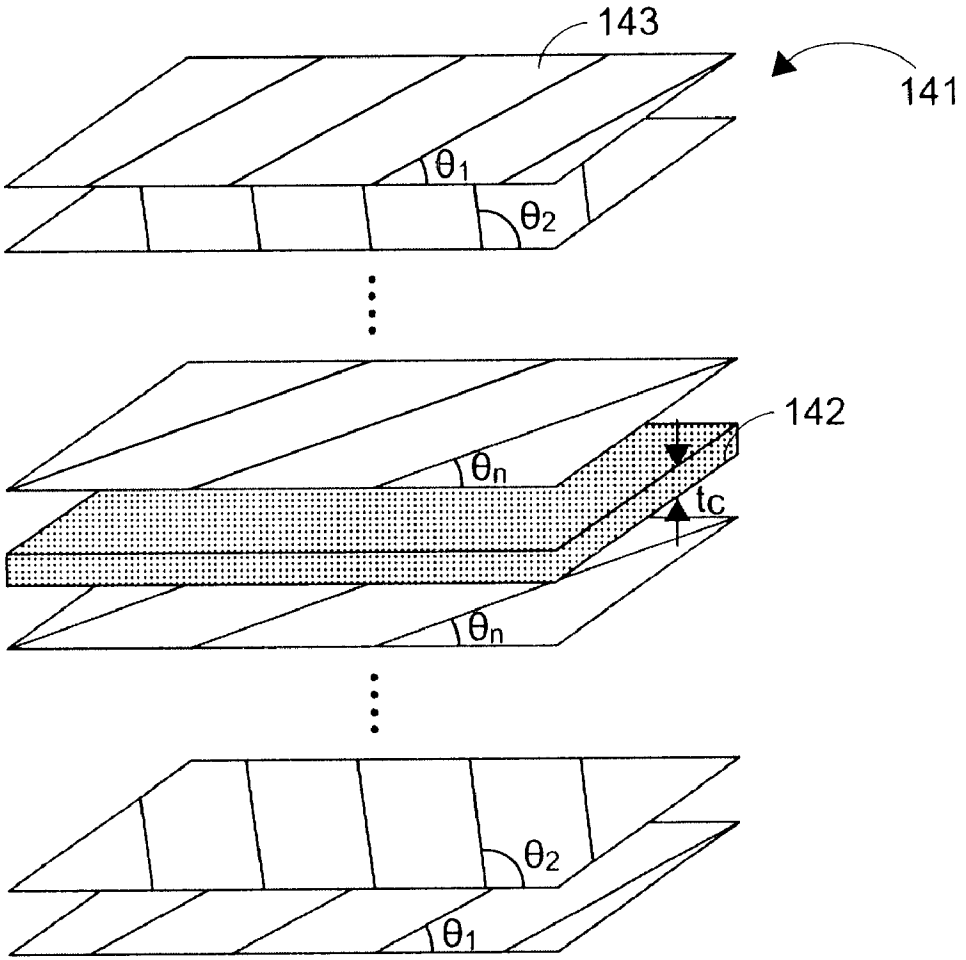
FIG. 6 is an exploded view of a laminated composite plate applied to a rectangular panel-form loudspeaker of the present invention.

Referring to FIG. 6. The laminated composite plate 140 comprises an intermediate core layer 142 and two fiber-reinforced polymeric layers 141. The intermediate core layer 142 is sandwiched between these two fiber-reinforced polymeric layers 141. Each of the two fiber-reinforced polymeric layers 141 comprises from one to four uni-axial fiber-reinforced laminae 143. Each uni-axial fiber-reinforced lamina 143 has a specified included angle $\theta_1, \theta_2, \ldots, \theta_n$ in respect to long peripheral edges of the laminated composite plate 140. The uni-axial fiber-reinforced lamina 143 is preferably made glass fiber-reinforced polymeric resin, carbon fiber-reinforced polymeric resin, Kevlar fiber-reinforced polymeric resin and boron fiber-reinforced polymeric resin. Such resin is selected from a group consisting of epoxy resin, phenolic aldehyde resin and polyester.

In accordance with the present invention, the effective modal parameters identification method is utilized to identify advantageous modal parameters for producing an optimized sound pressure distribution. It is preferred to symmetrically arrange the uni-axial fiber-reinforced lamina. It is assumed that the included angles parallel and vertical in respect to long peripheral edges of the laminated composite plate 140 are 0° and 90°, respectively, the optimized lamination is expressed as $[\theta_1/\theta_2/\Lambda/\theta_n/t_c]_s$, where $\theta_n$ is an included angle of the nth uni-axial fiber-reinforced lamina, $t_c$ is a half thickness of the intermediate core layer, the suffix s means a symmetric lamination. As a result, the thickness of each uni-axial fiber-reinforced lamina and the intermediate core layer are at most 0.2 mm and at most 5 mm, respectively. It is of course that laminated composite plate can be laminated with only uni-axial fiber-reinforced laminae without the intermediate core layer. Preferably, the number of laminated uni-axial fiber-reinforced laminae is between 1 and 4, and the included angle is one of 0°, 90°, 45° and −45°. Furthermore, each of the fiber-reinforced polymeric layers has a ratio of modulus to density from 80 to 380 GPa/(g/cm$^3$) in fiber direction, and from 3 to 80 GPa/(g/cm$^3$) in matrix direction, respectively. The intermediate core layer has a ratio of modulus to density from 1 to 20 GPa/(g/cm$^3$). The examples of the intermediate core layer according to the present invention include a PU foam plate, a PV foam plate, a paperboard or a honeycomb core. Preferably, the intermediate core layer has a ratio of modulus to density from 1 to 20 GPa/(g/cm$^3$).

Figure 7A:
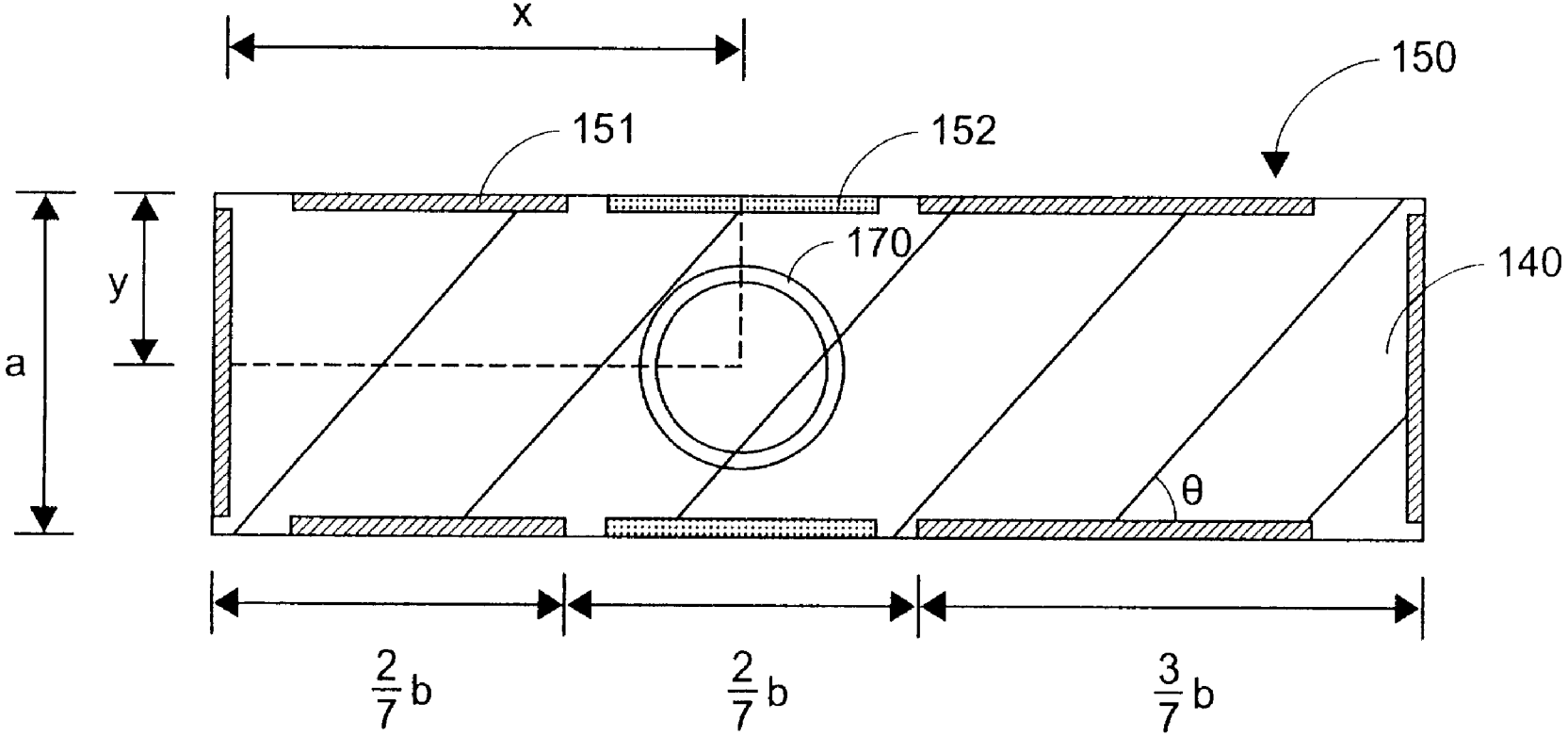
FIGS. 7(*a*) and 7(*b*) schematically show locations of a voice coil assembly and a suspending unit applied to a rectangular panel-form loudspeaker of the present invention.
Figure 7B:
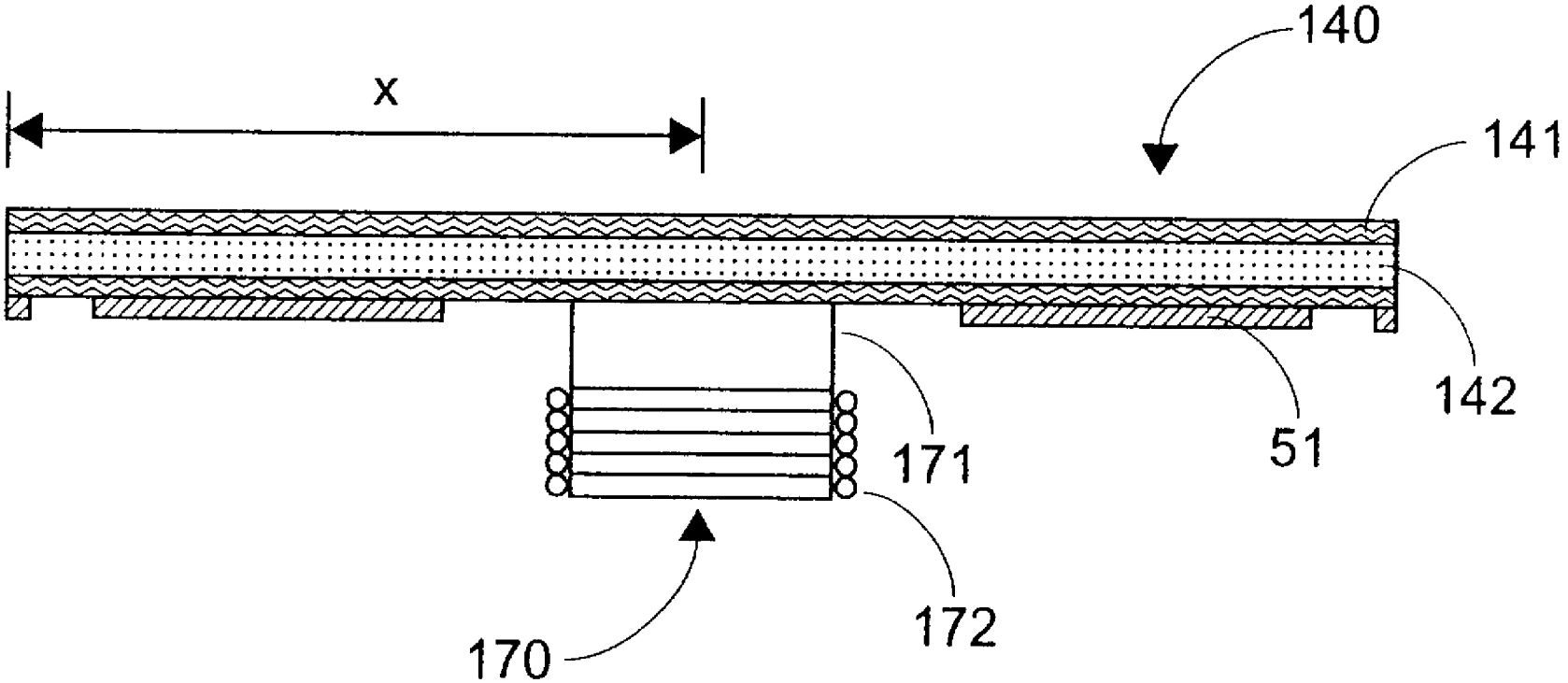

Please refer to FIGS. 7(*a*) and 7(*b*). The voice coil assembly 170 comprises a cylindrical film 171 and a coil 172 wound around the cylindrical film 171. The suspending unit 150 comprises a plurality of strips with different softness. The first strips 151 and the second strips 152 have relatively low and high softness, respectively. These strips can be selected from rubber-impregnated strips, foam type continuous strips and corrugated shell strips. The results by means of the effective modal parameters identification method show that these two strips have softness from 0.1 to 10 cm$^2$/N and from 10 to 100 cm$^2$/N, respectively. The location of the voice coil assembly 170 is selected in respect to a corner of the laminated composite plate such that the center of the voice coil assembly 170 has a first distance x of ⅔b to ½b from the short peripheral edge and a second distance y of ¼a to ¾a from the long peripheral edge of the laminated composite plate 140. The locations of the strips are selected in respect to a corner of the laminated composite plate 140 such that two first strips 151 with a length of ¾a to a are symmetrically disposed on the short peripheral edge of the laminated composite plate 140, two first strips 151 with a length less than ⅔b are symmetrically disposed in a distance of 0 to ⅔b from the short peripheral edge of the laminated composite plate 140, two second strips 152 with a length less than ⅔b are symmetrically disposed in a distance of 0 to ⅔b from the short peripheral edge of the laminated composite plate 140, and two first strips 151 with a length less than ⅗b are symmetrically disposed in a distance of ⅘b to b from the short peripheral edge of the laminated composite plate 140.

It is known from the foregoing description that a more effective shape of vibration mode is generated due to the structure of uni-axial fiber-reinforced polymeric layers and the utilization of the effective modal parameters identification method. Furthermore, since there is no resilience support between the voice coil assembly and the magnet assembly, the disadvantages of relatively high initial response frequency and considerable fluctuations of the sound pressure spectrum can be avoided accordingly.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims, which are to be accorded with the broadest interpretation so as to encompass all such modifications and similar structures.

What is claimed is:

1. A structure of a rectangular panel-form loudspeaker comprising:

a radiating panel comprising a rectangular laminated composite plate including length b, width a, and an intermediate core layer sandwiched between two fiber-reinforced polymeric layers, wherein the two fiber-reinforced polymeric layers include at least one uni-axial fiber-reinforced laminate, which is configured to produce a uniform sound pressure sensitivity spectrum over a frequency range when producing a flexural vibration;

a transducer for exciting said radiating panel to produce the flexural vibration, said transducer comprising a voice coil assembly and a magnet assembly, wherein said voice coil assembly is coupled to a first side of said laminated composite plate at a first specified location;

a frame for positioning said laminated composite plate and said magnet assembly; and a suspending unit including a soft material and disposed between peripheral edges of said laminated composite plate and said frame.

2. The structure according to claim 1 wherein the ratio of b to a is greater than 1.3.

3. The structure according to claim 1 wherein each uni-axial fiber-reinforced lamina has a thickness of at most 0.2 mm.

4. The structure according to claim 1 wherein each uni-axial fiber-reinforced lamina has an included angle selected from a group consisting of 0°, 90°, 45° and −45°, in respect to long peripheral edges of said laminated composite plate.

5. The structure according to claim 1 wherein each of said fiber-reinforced polymeric layers has a ratio of modulus to density in fiber direction from 80 to 380 GPa/(g/cm$^3$).

6. The structure according to claim 1 wherein each of said fiber-reinforced polymeric layers has a ratio of modulus to density in matrix direction from 3 to 80 GPa/(g/cm$^3$).

7. The structure according to claim 1 wherein each of said fiber-reinforced polymeric layers is made of a material selected from a group consisting of glass fiber-reinforced polymeric resin, carbon fiber-reinforced polymeric resin, Kevlar fiber-reinforced polymeric resin and boron fiber-reinforced polymeric resin, and each of said fiber-reinforced polymeric layers comprises a polymeric resin selected from a group consisting of epoxy resin, phenolic aldehyde resin and polyester.

8. The structure according to claim 1 wherein said intermediate core layer has a thickness of at most 5 mm.

9. The structure according to claim 1 wherein said intermediate core layer has a ratio of modulus to density from 1 to 20 GPa/(g/cm$^3$).

10. The structure according to claim 1 wherein said intermediate core layer is selected from a group consisting of a PU foam plate, a PV foam plate, a paperboard and a honeycomb core.

11. The structure according to claim 1 wherein said voice coil assembly comprises a cylindrical film and a coil wound around said cylindrical film.

12. The structure according to claim 1 wherein said first specified location is selected in respect to a corner of said laminated composite plate such that the center of said voice coil assembly has a first distance of 2/7b to ½b from the short peripheral edge and a second distance of ¼a to ¾a from the long peripheral edge of said laminated composite plate.

13. The structure according to claim 1 wherein said frame is in a rectangular shape with a hollow region in the center, and said frame has a bottom side and a peripheral side for supporting said suspending unit and surrounding said laminated composite plate, respectively.

14. The structure according to claim 13 wherein said suspending unit comprises a plurality of first strips with a first softness and a plurality of second strips with a second softness on said bottom side of said frame at a second specified location.

15. The structure according to claim 14 wherein said first softness is from 0.1 to 10 cm2/N and said second softness is from 10 to 100 cm$^2$/N.

16. The structure according to claim 14 wherein said second specified location is selected in respect to a corner of said laminated composite plate such that two first strips with a length of ¾a to a are symmetrically disposed on the short peripheral edge of said laminated composite plate, two first strips with a length less than 2/7b are symmetrically disposed in a distance of 0 to 2/7b from the short peripheral edge of said laminated composite plate, two second strips with a length less than 2/7b are symmetrically disposed in a distance of 0 to 2/7b from the short peripheral edge of said laminated composite plate, and two first strips with a length less than 3/7b are symmetrically disposed in a distance of 4/7b to b from the short peripheral edge of said laminated composite plate.

17. The structure according to claim 1 wherein said magnet assembly comprises a disk-shaped top plate, a cylindrical permanent magnet and a cap-like permeance unit, said permanent magnet has a first surface connected with said top plate concentrically, said permeance unit comprises a cup and a ring edge extending from a mouth of said cup, said top plate and said permanent magnet are disposed within said cup, said permanent magnet has a second surface connected to the bottom surface of said cup, and said top plate is at a level substantially similar to that of said ring edge, thereby generating a magnetic field in a gap between said top plate, said permanent magnet and said permeance unit.

18. The structure according to claim 17 wherein said frame is in a rectangular shape with a hollow region in the center, and said frame has a bottom side and a peripheral side for supporting said suspending unit and surrounding said laminated composite plate, respectively.

19. The structure according to claim 18 wherein each of the two long peripheral edges of said frame has a protruding ear corresponding to said ring edge of said permeance unit.

20. A radiating panel for a panel-form loudspeaker comprising:

an intermediate core layer having a first rigidity; and two fiber-reinforced polymeric layers on a first and a second sides of said intermediate core layer, each fiber-reinforced polymeric layer having a second rigidity in a fiber direction and a third rigidity in a matrix direction, wherein said intermediate core layer and said two fiber-reinforced polymeric layers are laminated to define a rectangular laminated composite plate with length b and width a; wherein the fiber-reinforced polymeric layers include at least one uni-axial fiber-reinforced laminate, which is configured to produce a uniform sound pressure sensitivity spectrum over a frequency range when excited by a transducer.

21. The structure according to claim 1, wherein said transducer is arranged at the center of said rectangular laminated composite plate.

22. The radiating panel according to claim 20, wherein the radiating panel is configured to receive said transducer at a first distance x of 2/7b to ½b from a short peripheral edge and a second distance y of ¼a to ¾a from a long peripheral edge of said rectangular laminated composite plate.

23. The radiating panel according to claim 20, wherein the radiating panel is configured to receive said transducer at a center of said rectangular laminated composite plate.

* * * * *